US009977454B1

(12) United States Patent
Krishnamoorthy

(10) Patent No.: US 9,977,454 B1
(45) Date of Patent: May 22, 2018

(54) METHODS AND APPARATUSES FOR A CMOS-BASED PROCESS INSENSITIVE CURRENT REFERENCE CIRCUIT

(71) Applicant: Cadence Design Systems, Inc., San Jose, CA (US)

(72) Inventor: Hareesh Pathamadai Krishnamoorthy, Bangalore (IN)

(73) Assignee: Cadence Design Systems, Inc., San Jose, CA (US)

( * ) Notice: Subject to any disclaimer, the term of this patent is extended or adjusted under 35 U.S.C. 154(b) by 0 days. days.

(21) Appl. No.: 14/862,932

(22) Filed: Sep. 23, 2015

(51) Int. Cl.
*G05F 3/26* (2006.01)

(52) U.S. Cl.
CPC ..... *G05F 3/262* (2013.01)

(58) Field of Classification Search
CPC ..... G05F 3/262; G05F 3/267
USPC ..... 323/315, 316
See application file for complete search history.

(56) References Cited

U.S. PATENT DOCUMENTS 5,892,388 A * 4/1999 Chiu ..... G05F 3/267 323/315
6,747,498 B1 * 6/2004 Pauletti ..... H04L 12/40032 327/198
2011/0193544 A1 * 8/2011 Iacob ..... G05F 3/242 323/315
2013/0120930 A1 * 5/2013 Temkine ..... G01K 7/01 361/679.47
2013/0294481 A1 * 11/2013 Koyama ..... G01K 7/01 374/163
2014/0028408 A1 * 1/2014 Wang ..... H03K 3/02315 331/144
2017/0023416 A1 * 1/2017 Kim ..... G01K 7/01

OTHER PUBLICATIONS

Borejko, T., et al., "A Resistorless Voltage Reference Source for 90 nm CMOS Technology with Low Sensitivity to Process and Temperature Variations," IEEE, copyright 2008 (6 pages).

(Continued)

*Primary Examiner* — Timothy J Dole
*Assistant Examiner* — Bart Iliya
(74) *Attorney, Agent, or Firm* — Vista IP Law Group, LLP

(57) ABSTRACT

Disclosed are apparatuses and methods for implementing CMOS-based, process insensitive current reference circuit (s). An apparatus includes a constant transconductance circuitry including a first and second current mirrors and respectively generating constant currents across one or more process corners, a resistive transistor in the constant transconductance circuitry having a resistance, and a feedback circuitry coupled with the resistive transistor and the constant transconductance circuitry to form a constant current source. The apparatus may optionally include a data processing module as well as another constant transconductance circuitry, another resistive transistor, and another feedback circuitry that form another constant current source. A method for implementing a system on chip may identify first and second currents generated by process insensitive current circuits, determine first and second temperature dependent voltages, and generate a digital output by transforming the first and second temperature dependent voltages.

16 Claims, 10 Drawing Sheets

(56) References Cited

OTHER PUBLICATIONS

Sengupta, Susanta, Kanan Saurabh, and Phillip E. Allen. "A process, voltage, and temperature compensated CMOS constant current reference." Circuits and Systems, 2004. ISCAS'04. Proceedings of the 2004 International Symposium on. vol. 1. IEEE, 2004.
"Moortec Embedded Temperature Sensor (METS) with trim capability" Mortec Semiconductor, Nov. 15, 2013.
"Auxiliary Temperature Sensor IP, Analog Datasheet", Cadence Design Systems, Inc., Dec. 2014.
Borejko, Tomasz, and Witold A. Pleskacz. "A resistorless voltage reference source for 90 nm cmos technology with low sensitivity to process and temperature variations." Design and Diagnostics of Electronic Circuits and Systems, 2008. DDECS 2008. 11th IEEE Workshop on. IEEE, 2008.
Pertijs, Michiel AP, Kofi AA Makinwa, and Johan H. Huijsing. "A CMOS smart temperature sensor with a 3? inaccuracy of±0. 1° C. from-55° C. to 125° C." IEEE Journal of Solid-State Circuits 40.12 (2005): 2805-2815.
Gravati, Mirko, et al. "A novel current-mode very low power analog CMOS four quadrant multiplier." Solid-State Circuits Conference, 2005. ESSCIRC 2005. Proceedings of the 31st European. IEEE, 2005.
Khan, Qadeer Ahmad, Sanjay Kumar Wadhwa, and Kulbhushan Misri. "A low voltage switched-capacitor current reference circuit with low dependence on process, voltage and temperature." VLSI Design, 2003. Proceedings. 16th International Conference on. IEEE, 2003.
Narendra, Siva, Daniel Klowden, and Vivek De. "Sub-1 V process-compensated MOS current generation without voltage reference." VLSI Circuits, 2001. Digest of Technical Papers. 2001 Symposium on. IEEE, 2001.
Oguey, Henri J., and Daniel Aebischer. "CMOS current reference without resistance." IEEE Journal of Solid-State Circuits 32.7 (1997): 1132-1135.
Vittoz, Eric, and Jean Fellrath. "CMOS analog integrated circuits based on weak inversion operations." IEEE journal of solid-state circuits 12.3 (1977): 224-231.
"S3ADTS1M12BGF65: 12-bit Digital Temperature Sensor", S3 Group.

* cited by examiner

METHODS AND APPARATUSES FOR A CMOS-BASED PROCESS INSENSITIVE CURRENT REFERENCE CIRCUIT

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Temperature sensors or generally thermometers have been widely applied in numerous fields such as measurements, instrumentation, control systems, etc. A temperature sensor circuit includes two bipolar junction transistors (BJTs) through which electric currents flow. Most temperature sensors are conventional sensors such as thermistors or platinum resistors that require separate readout circuitry. Recent development in temperature sensors includes sensors that output readily interpretable temperature readings in a digital format as well as the advent of smart temperature sensors that combine a temperature sensor with interface electronics on a single chip. Smart temperature sensors manufactured with the standard, low-cost CMOS (complementary metal-oxide-semiconductor) technology have their own limitations such as limited operating ranges (e.g., from −55-degree to 125-degree Celsius), relatively low accuracy compared to conventional temperature sensors due to process variations (e.g., within-die, from-die-to-die, cross-substrate, or cross-tools process variations) during the manufacturing of the smart temperature sensors.

Various improvements have been developed to improve the accuracy of smart temperature sensors by, for example, employing the one-point trimming techniques to trim transistor's emitter area and/or its bias current with a sigma-delta digital-to-analog converter and/or by adding a programmable PTAT (proportional to absolute temperature) voltage to certain transistors in smart temperature sensors to compensate for the spread in the nominal value of a transistor's saturation current and the spread of the bias current. In addition, the bandgap voltage from a typical bandgap voltage reference circuit in smart temperature sensors manufactured with the CMOS technologies exhibit second order effects and thus often require two-point trimming techniques to compensate for process variations. These one-point trimming techniques, two-point trimming techniques, or the addition of a programmable PTAT voltage are not only complex and often, if not always, require a larger silicon area for implementation. The requirement of a larger area on silicon offsets or even negates the low-cost benefit of manufacturing smart temperature sensors with the standard CMOS technologies.

Therefore, there exists a need for a CMOS-based current reference circuit that is independent of or at least insensitive to process variations and produces digital readout with improved accuracy yet without separate readout circuitry. The CMOS-based current reference circuit produces digital readouts with improved accuracy without trimming although the adoption of trimming techniques in some embodiments may further improve the accuracy of the digital readouts.

SUMMARY

Disclosed are methods and apparatuses of a CMOS-based, process insensitive current reference circuit in various embodiments. It shall be noted that although some working examples provided below refer to temperature sensors, these working examples are provided for the ease of illustration and explanations and are not intended to limit the application of the CMOS-based, process insensitive current reference circuit to only temperature sensors.

Some embodiments are directed to a CMOS-based, process insensitive current reference circuit that includes a constant transconductance circuitry comprising a first current mirror and a second current mirror and generating a constant electric current across one or more process corners, a resistive transistor located in the constant transconductance circuitry and having a resistance value, and a feedback circuitry coupled with the first current mirror, the second current mirror, and the resistive transistor to maintain the resistance value of the resistive transistor at or around a constant resistance value.

The CMOS-based, process insensitive current reference circuit may further include an isolation transistor located in the constant transconductance circuitry between and operatively coupled with the first current mirror and the second current mirror in some embodiments. In some of these embodiments, a drain of the isolation transistor may be operatively coupled with a drain of a first reversed transistor in the first current mirror comprising the first reversed transistor and a first transistor, and an source of the isolation transistor may be operatively coupled with a drain of a second transistor in the second current mirror comprising the second transistor and a second reversed transistor.

In addition or in the alternative, an source of the isolation transistor may be operatively coupled with a drain of a second transistor in the second current mirror comprising the second transistor and a second reversed transistor. In some embodiments, the feedback circuitry may include a current adjustment transistor generating an adjustable electric current according to a multiplication factor and a voltage adjustment transistor operatively coupled with the current adjustment transistor and the resistive transistor.

Optionally, a gate of the voltage adjustment transistor may be coupled with a drain of the voltage adjustment transistor and a drain of the current adjustment transistor in the feedback circuitry. In addition or in the alternative, a gate of the voltage adjustment transistor may be coupled with a gate of the resistive transistor in the constant transconductance circuitry, and a drain of the voltage adjustment terminal may be coupled with a drain of the resistive transistor.

Some embodiments are directed to an apparatus that includes a first CMOS-based, process insensitive current reference circuit generating a first constant electric current, a first transistor operatively coupled with the first CMOS-based, process insensitive current reference circuit, a second CMOS-based, process insensitive current reference circuit generating a second constant electric current, a second transistor operatively coupled with the first CMOS-based, process insensitive current reference circuit, and a data processing module operatively coupled with the first a first CMOS-based, process insensitive current reference circuit and the second CMOS-based, process insensitive current reference circuit.

In some of these embodiments, the first transistor may be operatively coupled with the first CMOS-based, process insensitive current reference circuit and generating a first voltage in response to the first constant electric current generated by the first CMOS-based, process insensitive current reference circuit. In addition or in the alternative, the second transistor may be operatively coupled with the second CMOS-based, process insensitive current reference circuit and generating a second voltage in response to the second constant electric current generated by the first CMOS-based, process insensitive current reference circuit.

In some embodiments, the first and second CMOS-based, process insensitive current reference circuit may be devised to respectively generate the first constant electric current and the second constant electric current at a current ratio that is greater than one. Optionally, the data processing module may include an analog-to-digital conversion module that converts the first voltage and the second voltage into a digital reading output. In addition or in the alternative, the first constant electric current may be maintained at a first constant value, and the second constant electric current may be maintained at a second constant value across one or more process corners.

Some embodiments are directed to method for implementing a system on chip comprising one or more CMOS-based, process insensitive current reference circuits. A first reference electric current generated by a first CMOS-based, process insensitive current reference circuit and a second reference electric current generated by a second CMOS-based, process insensitive current reference circuit may be identified; a first temperature dependent voltage and a second temperature dependent voltage produced by the first and second CMOS-based, process insensitive current reference circuits may be determined; the first and second temperature dependent voltages may be stored respectively at a first location and a second location of a non-transitory machine readable storage medium; and a digital reading output may be generated by transforming the first and second dependent voltages that are respectively stored at the first location and the second location of the non-transitory machine readable storage medium in these embodiments.

In some of these embodiments, a temperature measurement device comprising the first and second CMOS-based, process insensitive current reference circuits may be identified. In addition or in the alternative, a first transistor that is operatively coupled with and receiving the first reference electric current generated by the first CMOS-based, process insensitive current reference circuit may be identified; and a first base-to-emitter voltage produced by the first transistor in response to the first reference electric current may be determined.

In some of these preceding embodiments, a second transistor that is operatively coupled with and receives the second reference electric current generated by the second CMOS-based, process insensitive current reference circuit may be identified; and a second base-to-emitter voltage produced by the second transistor in response to the second reference electric current may be determined.

In addition or in the alternative, the first base-to-emitter voltage and the second base-to-emitter voltage may be respectively stored as an input voltage in the non-transitory machine readable storage medium; the first temperature dependent voltage may be determined by multiplying an amplification factor with a difference between the first base-to-emitter voltage and the second base-to-emitter voltage; and the second temperature dependent voltage may be determined by adding the temperature dependent voltage to either the first base-to-emitter voltage or the second base-to-emitter voltage.

In some embodiments, the method may further include the act of controlling the first reference electric current at a first constant value at least by maintaining a first resistance value of a first resistive transistor in the first CMOS-based, process insensitive current reference circuit and the act of controlling the second reference electric current at a second constant value at least by maintaining a second resistance value of a second resistive transistor in the second CMOS-based, process insensitive current reference circuit.

Controlling a reference electric current may be performed at least by adjusting an adjustment electric current with an adjustment in a feedback circuitry in the CMOS-based, process insensitive current reference circuit according to variations of a first threshold voltage of a transistor in the CMOS-based, process insensitive current reference circuit with respect to process variations in manufacturing of the system on chip or a part thereof; adjusting a reference voltage produced by the CMOS-based, process insensitive current reference circuit based in part upon the adjustment to the adjustment electric current; and maintaining a resistance value of the resistive transistor in the CMOS-based, process insensitive current reference circuit at or around a constant.

In some embodiments, the method may also optionally include the act of identifying a plurality of transistors in a first current mirror of a CMOS-based, process insensitive current reference circuit and biasing the plurality of transistors to operate the plurality of transistors in a saturation region; the act of identifying a plurality of transistors in a second current mirror of the CMOS-based, process insensitive current reference circuit and biasing the plurality of transistors to operate the plurality of second transistors in a sub-threshold region; the act of identifying a plurality of feedback transistors in the CMOS-based, process insensitive current reference circuit and biasing the plurality of feedback transistors to operate the plurality of feedback transistors in the saturation region; the act of identifying an isolation transistor in the CMOS-based, process insensitive current reference circuit and biasing the isolation transistor to operate the isolation transistor in a linear region.

More details of various aspects of the methods and apparatuses of a CMOS-based, process insensitive current reference circuit are described below with reference to FIGS. 1A-3D.

BRIEF DESCRIPTION OF THE DRAWINGS

The drawings illustrate the design and utility of various embodiments of the invention. It should be noted that the figures are not drawn to scale and that elements of similar structures or functions are represented by like reference numerals throughout the figures. In order to better appreciate how to obtain the above-recited and other advantages and objects of various embodiments of the invention, a more detailed description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1A:
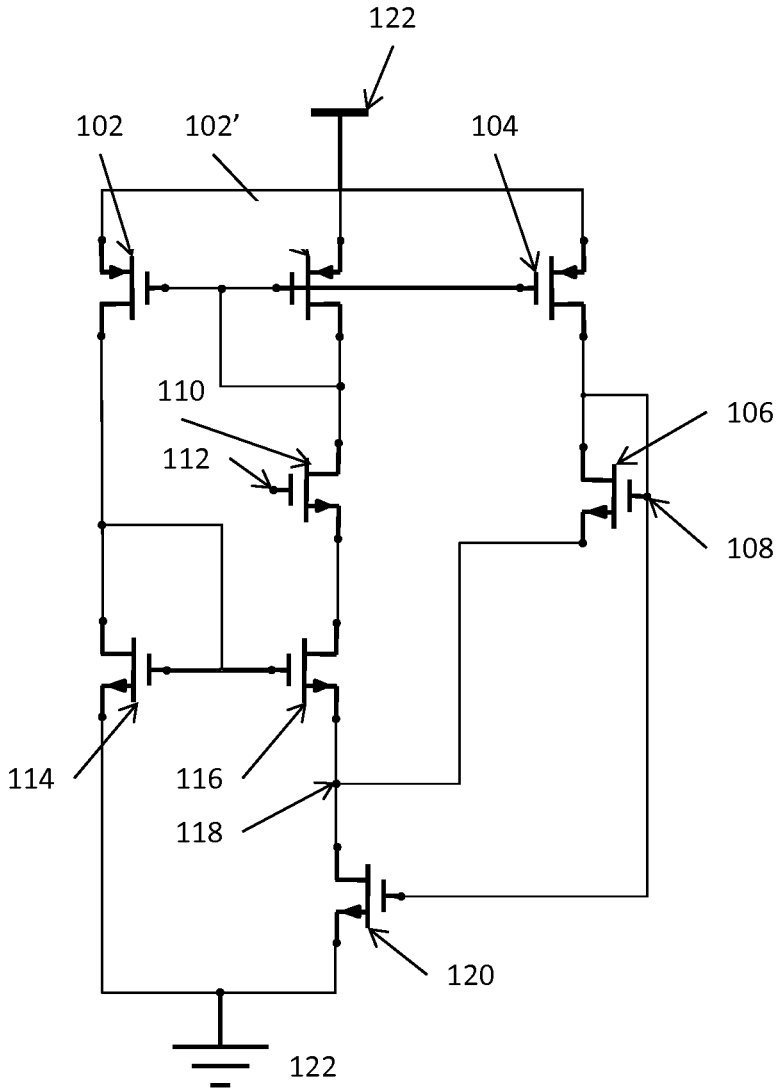
FIG. 1A illustrates an example of a CMOS-based, process insensitive current reference circuit in one or more embodiments.

Some embodiments are directed to methods and apparatus for implementing an a CMOS-based, process insensitive current reference circuit. Some other embodiments are directed to methods and apparatus for implementing an apparatus with CMOS-based, process insensitive current reference circuits. Other objects, features, and advantages of the invention are described in the detailed description, figures, and claims.

One advantage of these methods and apparatuses described herein is that the CMOS-based, process insensitive current reference circuit generates an electric current that is insensitive to or independent of manufacturing process variations (e.g., within-die, from-die-to-die, cross-substrate, or cross-tools process variations). The CMOS-based, process insensitive current reference circuit also produces a constant or substantially constant electric current that is independent of or at least insensitive to variations in the manufacturing process(es) of the single-chip CMOS-based, process insensitive current reference circuit.

This constant or nearly constant electric current is realized by including a resistive MOSFET (metal-oxide-semiconductor field-effect transistor), instead of a conventional resistor, in the constant transconductance circuitry in the CMOS-based, process insensitive current reference circuit. The resistance of the resistive transistor is maintained at a constant or nearly constant value by varying the current flowing in a feedback circuitry in the CMOS-based, process insensitive current reference circuit to adjust the reference voltage at the gate of the resistive transistor in an identical or substantial similar manner in which the threshold voltage of the resistive transistor varies across manufacturing process variations in some embodiments.

In these embodiments, the resistance value of the resistive transistor varies in an identical or substantially similar manner as the variation of the threshold voltage in the constant or substantially constant transconductance circuitry, and the CMOS-based, process insensitive current reference circuit generates the constant or substantially constant electric current independent of the variations of the threshold voltage due to variations of the manufacturing processes.

Another advantage is that a temperature sensor implemented with the CMOS-based, process insensitive current reference circuits produce the output that varies only with the mobility of the carriers in the transistors and substantially independent of or insensitive to the process variations. The process insensitive current reference circuits thus improve the accuracy of smart temperature sensors from, for example, 25% of a conventional bandgap reference current circuitry to 5% or lower (e.g., an improvement of about +/−2-degree Celsius) without employing any trimming techniques in some embodiments.

In some of these embodiments, the process insensitive current reference circuits may produce temperature readings with the accuracy of +/−3-degree Celsius. When the process insensitive current reference circuits deployed in a temperature sensor are further enhanced by employing one-point techniques, the accuracy may be further improved over the untrimmed process insensitive current reference circuits by another 50% or about another +/−1.5-degree Celsius.

In some of these embodiments, the process insensitive current reference circuits may produce temperature readings with the accuracy of +/−1.5-degree Celsius. With single-point trimming techniques, this accuracy may be improved further over the untrimmed process insensitive current reference circuits by more than +/−1.5-degree Celsius in some embodiments. In some of these embodiments, the process insensitive current reference circuits may produce temperature readings with the accuracy of +/−1.45-degree Celsius.

Another advantage is that a CMOS-based, process insensitive current reference circuit described herein does not include any bipolar junction transistors in some embodiments. In some embodiments where no trimming techniques are employed, the process insensitive current reference circuits produce identical or better accuracy than conventional single-chip temperature sensors that have been trimmed with the one-point or two-point trimming techniques. It shall be noted that although these embodiments use FETs (field effect transistors) instead of bipolar junction transistors (BJTs) in some embodiments (e.g., FIG. 1C), the use of FETs in the CMOS-based, process insensitive current reference circuit does not mean that BJTs are similarly excluded in other embodiments. Rather, some of these other embodiments may nevertheless use BJTs to achieve identical or substantially similar purposes. Moreover, it shall be further noted that the terms base, emitter, and collector are often used in describing a BJT, whereas the corresponding terms in an FET are gate, source, and drain. Nonetheless, the illustration of an FET or BJT or the description including gate-source-drain or base-emitter-collector does not limit the scope of certain embodiments or the scope of the claims as such. That is, although some drawing figures may be illustrated with one or more BJTs while some other drawing figures may be illustrated with one or more FETs, it is understood that various embodiments may be implemented with FETs along, BJTs along, or a combination of one or more BJTs and one or more FETs, and that the use of the set of terms gate-source-drain (for FETs) or base-emitter-collector (for BJTs) are not intended to limit the scope of other embodiments or the scope of the claims, unless otherwise specifically recited and emphasized.

With the standard CMOS manufacturing technologies and the absence of bipolar junction transistors, a process insensitive current reference circuit occupies a smaller silicon area and is thus more cost effective than a conventional single-chip temperature sensor with trimming techniques while producing equal or better accuracy over the conventional single-chip temperature sensors. In some embodiments where trimming techniques are employed to further improve the accuracy of a process insensitive current reference circuit in a temperature sensor, the silicon area of the single-chip temperature sensor is still smaller than a conventional single-chip temperature sensor employing similar or identical trimming techniques whereas the process insensitive current reference circuit provide even better accuracy than these conventional single-chip temperature sensors.

Various embodiments of the methods and apparatuses will now be described in detail with reference to the drawings, which are provided as illustrative examples of the invention so as to enable those skilled in the art to practice the invention. Notably, the figures and the examples below are not meant to limit the scope of various embodiments, unless otherwise specifically described in particular embodiment(s) or recited in the claim(s).

Where certain elements of embodiments may be partially or fully implemented using known components (or methods or processes), portions of such known components (or methods or processes) that are necessary for an understanding of the present invention will be described, and the detailed descriptions of other portions of such known components (or methods or processes) will be omitted for ease of explanation and to not obscure embodiments of the invention. Further, embodiments encompass present and future known equivalents to the components referred to herein by way of illustration. More details about various processes or modules to implement various embodiments are further described below with reference to FIGS. 1A-3D.

FIG. 1A illustrates an example of a CMOS-based, process insensitive current reference circuit in one or more embodiments. In these one or more embodiments, the CMOS-based, process insensitive current reference circuit receives an input source voltage ($V_{DD}$) 122 and generates an output reference voltage ($V_{REF}$) 108. The current reference circuit illustrated in FIG. 1A includes a constant or substantially constant transconductance circuitry and a feedback circuitry that is operatively connected to the constant or substantially constant transconductance circuitry.

The feedback circuitry includes the current adjustment transistor 104 and a voltage transistor 106. The current adjustment transistor 104, when receiving an input source voltage ($V_{DD}$) 122, generates a current that is equal to the current ("I") generated by transistor (e.g., a field effect transistor or a MOSFET) multiplied by a multiplying factor. The multiplying factor $\alpha$ may be adjusted or manipulated to set the output current al to a desired value. The drain of the current adjustment transistor 104 is coupled with the drain of the voltage adjustment transistor 106.

The base-to-emitter voltage ($V_{BE}$) or the output reference voltage ($V_{REF}$) 108 of the voltage adjustment transistor 106 is self-adjusting based in part or in whole upon the output current al of the current adjustment transistor 104 so that the base voltage varies in an identical or substantially similar manner as that of the threshold voltage ($V_{TH}$) of a resistive transistor 120 in the transconductance circuitry to maintain the resistance of the resistive transistor 120 at a constant or substantially constant value in some of these embodiments.

In these embodiments, varying the base voltage 108 may be achieved by varying the multiplying factor $\alpha$ in order to set the required current. The resistance of the resistive transistor 120 is maintained, however, at or around a constant resistance value regardless of the value of e multiplying factor $\alpha$. By maintaining the resistance of the resistive transistor 120 at a constant or substantially constant value, the current generated by the CMOS-based, process insensitive current reference circuit may thus be maintained at a constant or substantially constant value. In a typical transistor, the electric current varies with the mobility as well as process variations in the manufacturing processes of the transistor.

In some of these embodiments, the electric current generated by the CMOS-based, process insensitive current reference circuit may be decoupled from and thus become independent of or at least insensitive to process variations and dependent on only the mobility of the carriers in the transistor. As shown in FIG. 1A, the source and the gate of the voltage adjustment transistor 106 may be respectively coupled with the drain and the gate of the resistive transistor 120.

In addition, the gate of the voltage transistor 106 is coupled with the drain of the voltage transistor 106 so that the collector current serves as an input while the base-emitter serves as the output to provide a negative feedback and thus a reversed transistor for the voltage transistor 106. Both the current adjustment and voltage adjustment transistors 104 and 106 are to operate in the saturation region by driving a sufficient amount of current so the base-collector junctions and the base-emitter junctions of these two transistors become forward biased. A transistor in the saturation region facilitates high current conduction from the emitter to the collector (or the other direction in the case of NPN or negative, positive, negative transistors, with negatively charged carriers flowing from emitter to collector).

The constant or substantially constant transconductance circuitry (or a constant or substantially constant $g_m$ circuitry) includes a closed loop including two current mirrors. The first current mirror includes transistors 102 and 102' operating in the saturation region, and transistor 102' constitutes a reversed transistor by interconnecting its drain and its gate. The second current mirror includes core voltage transistors 114 and 116 where the core voltage transistor 114 constitutes a reversed transistor by interconnecting its drain and its gate.

In some of these embodiments, these two core voltage transistors 114 and 116 operate in the sub-threshold region where the gate voltage ($V_G$) is less than the threshold voltage ($V_{TH}$) and may be subject to a limited maximum drain-to-source voltage ($V_{DS}$) (e.g., 1.1V maximum $V_{DS}$), whereas transistors 102 and 102' may be subject to a higher maximum drain-to-source voltage (e.g., 1.98V maximum $V_{DS}$). To protect these two core voltage transistors 114 and 116, the first current source may be coupled with the second source via an isolation transistor 110 at a base voltage 112.

The isolation transistor 110 serves to isolate the core voltage transistors 114 and 116 and may be subject to a higher voltage 112 (e.g., 2.5V) to operate in the saturation region where further increases in the electric current driven into the base barely increases or does not result in an increase in the available charge carriers crossing the base-collector junction. In some embodiments, the isolation transistor 110 includes an NPN transistor (e.g., field effect transistor or FET or a MOSFET) having a drain-to-source voltage larger than or equal to an predetermined voltage value (e.g., 100 mV).

In some embodiments, the isolation transistor 110 includes a transistor having a drain-to-source voltage ($V_{DS}$) to thermal voltage ($V_T$) ratio larger than or equal to a predetermined ratio (e.g., 4) and isolates the lower voltage core voltage transistors 114 and 116 from a higher voltage value (e.g., 1.1V) to protect these core voltage transistors 114 and 116 from exhibit or resulting in reliability or functional issues due to exposure to excessive voltages.

The gate of the isolation transistor 110 may be coupled with the gate of the reversed transistor 102' in the first current mirror; and the source of the isolation transistor 110 may be coupled with the drain of the transistor 116 in the second current mirror. The first current mirror, the second mirror, and the isolation transistor 110 thus form a closed loop having a gain greater than one ("1").

The constant or substantially constant transconductance circuitry may further include the resistive transistor 120 that controls the output current of the CMOS-based, process insensitive current reference circuit. As explained earlier, the electric current in a typical transistor varies with the mobility as well as process variations in the manufacturing processes of the transistor. One of the objectives of the CMOS-based, process insensitive current reference circuit is to generate a constant or substantially constant electric current that is independent of or insensitive to process variations.

In some embodiments, the objective may be achieved by maintaining the resistance of the resistive transistor 120 such that the CMOS-based, process insensitive current reference circuit may output a constant or substantially constant electric current that varies only with the mobility, despite process variations in the manufacturing processes for the current reference circuit. As presented earlier in the description of FIG. 1A, maintaining a constant or substantially constant resistance for the resistive transistor 120 may be achieved by varying the multiplying factor for transistor 104 in the feedback circuitry so that the reference voltage 108 varies in an identical or substantially similar manner as the threshold voltage of the resistive transistor 120.

In these embodiments, the electric current generated by the CMOS-based, process insensitive current reference circuit may be decoupled from and thus become independent of or at least insensitive to process variations and dependent only upon the mobility of the carriers in the resistive transistor. In these embodiments, the resistive transistor 120 is held at or around a constant resistance value by the feedback circuitry including the current adjustment transistor 104 and the voltage adjustment transistor 106; and the feedback circuitry varies the current from the current adjustment transistor 104 to adjust the reference voltage 108 to vary in an identical or substantially similar manner as the threshold voltage ($V_{TH}$) of the resistive transistor 120 to maintain the resistance of the resistive transistor 120 at a constant or substantially constant value. The resistive transistor 120 is biased to operate in the linear region where the collector current $I_C$ is proportional to the base current $I_B$ in a relation such as $I_C=\beta\times I_B$, where β is a constant.

In the CMOS-based, process insensitive current reference circuit illustrated in FIG. 1A, the transistors 102, 102', 104, 106, and 110 operate in the saturation region; the transistors 114 and 116 operate in the sub-threshold region; and the transistor 120 operates in the linear region. Because the core voltage transistors 114 and 116 carry equal electric currents, the electric current ("I") through transistors 102 and 102' may be respectively written in Equations (1) and (2) below.

$$I=A_3e^{(V_{GS3}-V_{TH})/(m\times V_T)}\times(1-e^{-(V_{DS}/V_T)}) \quad (1)$$

$$I=A_4e^{(V_{gs4}-V_{TH})/(m\times V_T)}\times(1-e^{-(V_{DS}/V_T)}) \quad (2)$$

In Equations (1) and (2), $$A_3=\mu_3\times C_{ox3}\times\left(\frac{W}{L}\right)_3\times(m-1)\times V_T^2;$$

$\mu_3$ denotes the electron surface mobility or the effective mobility; W denotes the channel width of the transistor 102; L denotes the channel length of the transistor 102; $V_{DS}$ denote the drain-to-source voltage of the transistor 102; $V_{GS3}$ denotes the gate-to-source voltage of the transistor 102; $V_{TH}$ denotes the threshold voltage; $V_T$ denotes the thermal voltage; and (m−1) denotes the ratio of the capacitance of the depletion layer ($C_{DEP3}$) to the capacitance of the oxide layer ($C_{OX3}$) or ($C_{DEP3}/C_{OX3}$) of the transistor 102.

$$A_3=\mu_4\times C_{ox4}\times\left(\frac{W}{L}\right)_4\times(m-1)\times V_T^2;$$

$\mu_4$ denotes the electron surface mobility or the effective mobility; W denotes the channel width of the transistor 102'; L denotes the channel length of the transistor 102'; $V_{DS}$ denote the drain-to-source voltage of the transistor 102'; $V_{GS4}$ denotes the gate-to-source voltage of the transistor 102'; $V_{TH}$ denotes the threshold voltage; $V_T$ denotes the thermal voltage; and (m−1) denotes the ratio of the capacitance of the depletion layer ($C_{DEP4}$) to the capacitance of the oxide layer ($C_{OX4}$) or ($C_{DEP4}/C_{OX4}$) of the transistor 102'.

In some embodiments where the drain-to-source voltage is maintained at above a predetermined voltage value (e.g., 100 mV or $V_{DS}$>100 mV) or where ratio of the drain-to-source voltage to the thermal voltage ($V_T$) is maintained above a predetermined ratio (e.g., $V_{DS}/V_T>4$), the exponential term $e^{-(V_{DS}/V_T)}$ may be neglected. In these embodiments, transistor 102 and transistor 102' carrying the same electric current provides:

$$V_{GS3}-V_{GS4}=V_T\times\ln(A_4/A_3) \quad (3)$$

The right-hand side of Equation (8) is independent of or at least insensitive to process variations and is proportional to absolute temperature (PTAT) in nature. In addition, the CMOS-based, process insensitive current reference circuit illustrated in FIG. 1A further provides that:

$$V_{GS3}-V_{GS4}=V_{DS} \quad (4)$$

In FIG. 1A, reference numeral 118 denotes the drain-to-source voltage ($V_{DS}$). Therefore, Equations (3)-(4) also provide that the drain to source voltage ($V_{DS}$) is also PTAT in nature.

Moreover, because the resistive transistor 120 is biased to operate in the linear region, the relation between the drain-to-source voltage and the resistance of the resistive transistor 120 may be expressed as Equation (5) below.

$$V_{DS}=I\times(1+\alpha)\times R_{120} \quad (5)$$

In Equation (5), $V_{DS}$ denotes the drain-to-source voltage; I denotes the electric current; $R_{120}$ denotes the resistance of the resistive transistor 120; and α denotes the multiplying factor described above for the feedback circuitry. With the reference voltage ($V_{REF}$) 108 described above, the resistance $R_{120}$ of the resistive transistor 120 may be expressed as follows:

$$R_{120}=1/\{K_{120}\times(V_{REF}-V_{TH})\} \quad (6)$$

In Equation (6) above, $V_{TH}$ denotes the threshold voltage; $V_{REF}$ denotes the reference voltage 108; $R_{120}$ denotes the resistance of the resistive transistor 120; and $K_{120}$ is given by $K_{120}=\mu\times C_{ox}\times(W/L)_{120}\}$, where $(W/L)_{120}$ denotes the channel width to channel length ratio of the resistive transistor 120.

Because the voltage adjustment transistor 106 is biased to operate in the saturation region, the following Equation (7) may be obtained:

$$\alpha\times I=(K_{106}/2)\times(V_{REF}-V_{DS}-V_{TH})^2 \quad (7)$$

In Equation (7) above, $K_{106}$ is given by $K_{106}=\mu\times C_{ox}\times(W/L)_{106}\}$; $\alpha$ denotes the multiplying factor described above for the feedback circuitry; $V_{REF}$, $V_{DS}$, $V_{TH}$ respectively denote the reference voltage 108, the drain-to-source voltage, and the threshold voltage. Equation (7) may be rewritten as follows:

$$V_{REF}=V_{RDS}+V_{TH}\sqrt{(2\times\alpha\times I)/K_{106}} \quad (8)$$

Substituting Equations (6) and (8) into Equation (5), the drain-to-source voltage ($V_{DS}$) may be expressed as follows:

$$V_{DS}=I\times(1+\alpha)/\{K_{120}\times(V_{TH}+\sqrt{(2\times\alpha\times I)/K_{106}})\} \quad (9)$$

Equation (9) may be expanded as a quadratic expression in I as provided by Equation (10) below:

$$((1+\alpha)/K_{120}\times V_{Ds})^2\times I^2-2\times\{(1+\alpha)/K_{120}+\alpha/K_{106}\}\times I+V_{DS}^2=0 \quad (10)$$

As it can be seen from Equation (10) above, Equation (10) does not include the $V_{TH}$ term that is a process dependent term. Also, the electric current ("/") is a function of $V_{DS}$ and K (given by $K=\mu C_{OX}(W/L)$) of a transistor of interest. $V_{DS}$ is process independent, and the variation of the electric current ("I") across process variations is thus dependent upon the variation of K with respect to process. The variation of K with respect to process is usually very little (e.g., less than a few percent such as 4-10%). Therefore, variations in the generated electric current ("I") are also very little, and the electric current generated by the CMOS-based, process insensitive current reference circuit may thus be deemed constant or substantially constant with respect to process variations although, without further compensation, the electric current may nevertheless slightly depend upon the process variations due to the dependency of K upon the process variations.

It shall be noted that the term "substantial" or "substantially" as in "substantially constant" electric current refers the electric current that exhibit no or slight dependency upon process variations, and that the slight dependency upon process variations may be neglected in some embodiments. The term "substantially constant" may also accommodate approximations or a design choice to neglect certain relatively minor or insignificant effects in obtaining the final solutions or intermediate solutions thereof in some embodiments.

For example, in expanding Equation (9) into a quadratic form or in devising the drain-to-source voltage ($V_{DS}$), some higher-order terms may be neglected or certain approximations may be made to provide sufficient accuracy without unnecessarily complicating the solution process in some embodiments. With these higher-order terms or approximations, a solution may not necessarily be exactly identical to a constant although the objective of the solution process is to obtain a constant through approximations and/or design choices.

For the ease of description and illustration, the term "substantially" may be omitted in this application without loss of generality. For example, the terms "substantially constant" and "constant" may be used interchangeably to mean both "exactly" constant and "substantially" or "approximately" constant; and the terms "substantially similar" and "identical" may also be used interchangeably to mean both "exactly" identical and "substantially" or "approximately" identical, unless otherwise explicitly specified in the description of embodiments or claims.

In some other embodiments, the slight dependency of K and thus the electric current may further constitute the subject of further improvement by employing trimming techniques. These trimming techniques may include, for example, trimming a transistor's emitter area, trimming the bias current with a sigma-delta digital-to-analog converter, or both in some embodiments. For example, the bias current of a transistor may be trimmed in order to compensate for the spread in the nominal value of the transistor's saturation current and/or the spread of the bias current itself.

In some embodiments, trimming the emitter area or the bias current may be achieved by employing a switchable binary-scaled transistors or bias current sources although these trimming techniques may require a larger silicon area for the single-chip temperature sensor. The trimming techniques may include the addition of a programmable PTAT voltage to a transistor. In some embodiments, trimming techniques may be implemented in part or in whole off the single-chip of the temperature sensor by using software applications without requiring any additional area on silicon.

Trimming techniques provide a trimming resolution in an order of 0.01-degree. In the context of varying the reference voltage (e.g., reference voltage 108) to maintain the resistance of the resistive transistor in a substantially similar manner, the substantially similar manner includes a way to adjust the reference voltage according to the variations of the threshold voltage ($V_{TH}$) so that the resistance given by Equation (6) may be maintained at a constant value or may exist sufficiently small (e.g., negligible) deviations from the constant value.

Figure 1B:
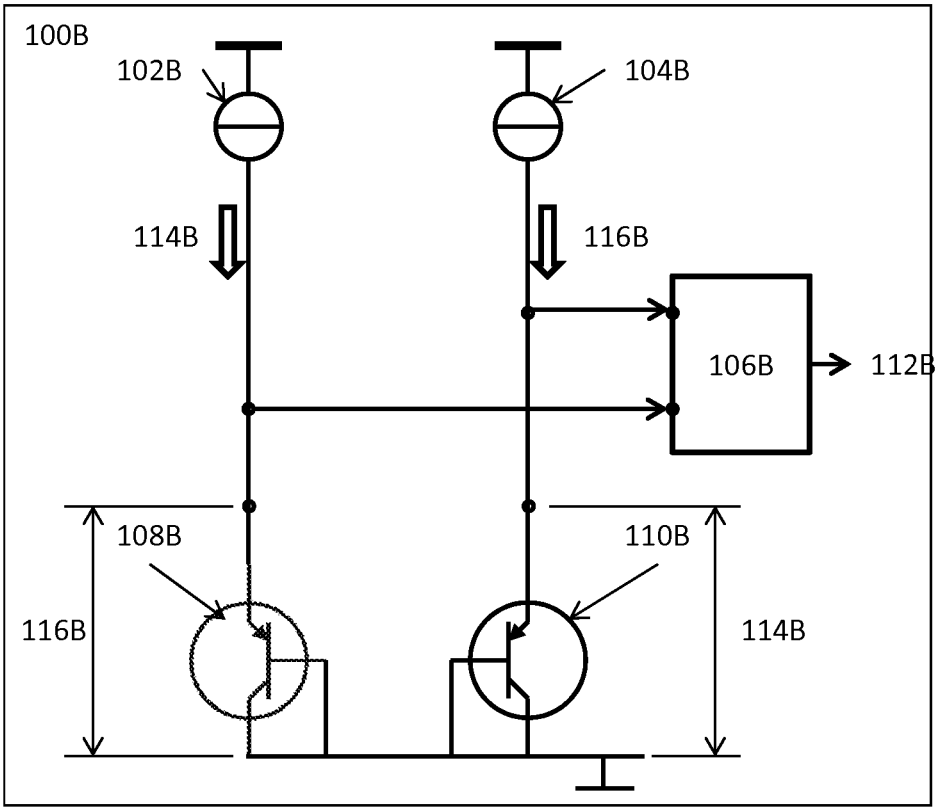
FIG. 1B illustrates an example of a temperature sensor including two CMOS-based, process insensitive current reference circuits that are identical to or substantially similar to the CMOS-based, process insensitive current reference circuit illustrated in FIG. 1A in one or more embodiments.

FIG. 1B illustrates an example of a temperature sensor including two CMOS-based, process insensitive current reference circuits that are identical to or substantially similar to the CMOS-based, process insensitive current reference circuit illustrated in FIG. 1A in one or more embodiments. In these embodiments, the temperature sensor 100B includes a first current source 104B that is a CMOS-based, process insensitive current reference circuit illustrated in FIG. 1A to generate a first electric current ("$I_{REF}$/N") 116B as well as a second current source 102B that is modified from the CMOS-based, process insensitive current reference circuit illustrated in FIG. 1A to generate a second electric current 114B ($I_{REF}$), where the multiplication factor N is a greater than one number.

A larger multiplication factor N produces the reference voltage that is more PTAT in nature but requires more area on silicon. In some embodiments, the multiplication factor N is 7. The first current source 104B is coupled with the source of a first bipolar junction transistor 110B to produce a first base-emitter voltage ($V_{BE1}$) 114B; and the second current source 102B is coupled with the source of a second bipolar junction transistor 108B to produce a second base-emitter voltage ($V_{BE2}$) 116B.

The gate is coupled with the drain of each of the bipolar junction transistors 108B and 110B and then to the ground. Both the first base-emitter voltage ($V_{BE1}$) and the second base-emitter voltage ($V_{BE2}$) are provided to a data processing module 106B that generates digital temperature reading outputs 112B. For example, the second base-emitter voltage ($V_{BE2}$) may be provided to the data processing module 106B as a reference voltage ($V_{REF}$); and the first base-emitter voltage ($V_{BE1}$) may be provided to the data processing module as an input voltage ($V_{IN}$). In the example illustrated in FIG. 1B, the electric currents $I_{REF}/N$ and $I_{REF}$ flow through the two bipolar junction transistors respectively to provide Equations (11)-(12) below:

$$\frac{I_{REF}}{N} \propto e^{(q \times V_{IN}/n \times E \times k \times T)} \tag{11}$$

$$I_{REF} \propto e^{(q \times V_{REF}/n \times E \times k \times T)} \tag{12}$$

The digital temperature reading output 112B may then be provided by Equation (13) below:

$$V_{IN}/V_{REF} = 1 - \ln(N) \times \ln(I/I_S) \tag{13}$$

In Equation (13), $I_S$ denotes the saturation current.

The data processing module 106B may optionally include an amplifier having a gain ("α"). The amplifier amplifies the difference $\Delta V_{BE}$ between the inputs on the positive and negative terminals by the gain ("α") and forwards the amplified voltage difference $\Delta V_{BE}$. In these embodiments, the amplifier receives $V_{REF}$ and $V_{IN}$ to amplify the voltage difference in the base-emitter voltages ($\Delta V_{BE}$) by the gain ("α") to produce the signal $\alpha \times \Delta V_{BE}$ that is PTAT in nature.

In some embodiments, the gain is a number equal to (non-amplified) or greater than one ("1"). The data processing module may further include an addition module that adds the amplified base-emitter voltage difference ($\alpha \times \Delta V_{BE}$) to the base-emitter voltage 114B ($V_{BE}$) of the first bipolar junction transistor 110B. That is, the addition module produces the result of $V_{REF} = V_{BE} + \alpha \times \Delta V_{BE}$. The signal $\alpha \times \Delta V_{BE}$ and VREF may then be provided to an analog-to-digital converter (ADC) to produce the digital temperature reading output 112B.

A mechanism or module described herein may be implemented as a pure software application stored in computer memory, pure hardware module (e.g., a block of electronic circuit components, electrical circuitry, etc.), or a combination of a hardware module and a software block that jointly perform various tasks to achieve various functions or purposes described herein or equivalents thereof. For example, a mechanism or module described herein may be implemented as an application-specific integrated circuit (ASIC) in some embodiments.

In these embodiments, a mechanism or module may thus include, for example, a microprocessor or a processor core and other supportive electrical circuitry to perform specific functions which may be coded as software or hard coded as a part of an application-specific integrated circuit, ROM (read only memory), PROM (programmable read only memory), EPROM (erasable programmable read only memory), registers, flops, buffers, etc. despite the fact that these microprocessor, processor core, and electrical circuitry may nevertheless be shared among a plurality of mechanism.

A mechanism or module described herein or an equivalent thereof may perform its respective functions alone or in conjunction with one or more other mechanisms. A mechanism described herein or an equivalent thereof may thus invoke one or more other mechanisms by, for example, issuing one or more commands or function calls. The invocation of one or more other mechanisms may be fully automated or may involve one or more user inputs.

Figure 1C:
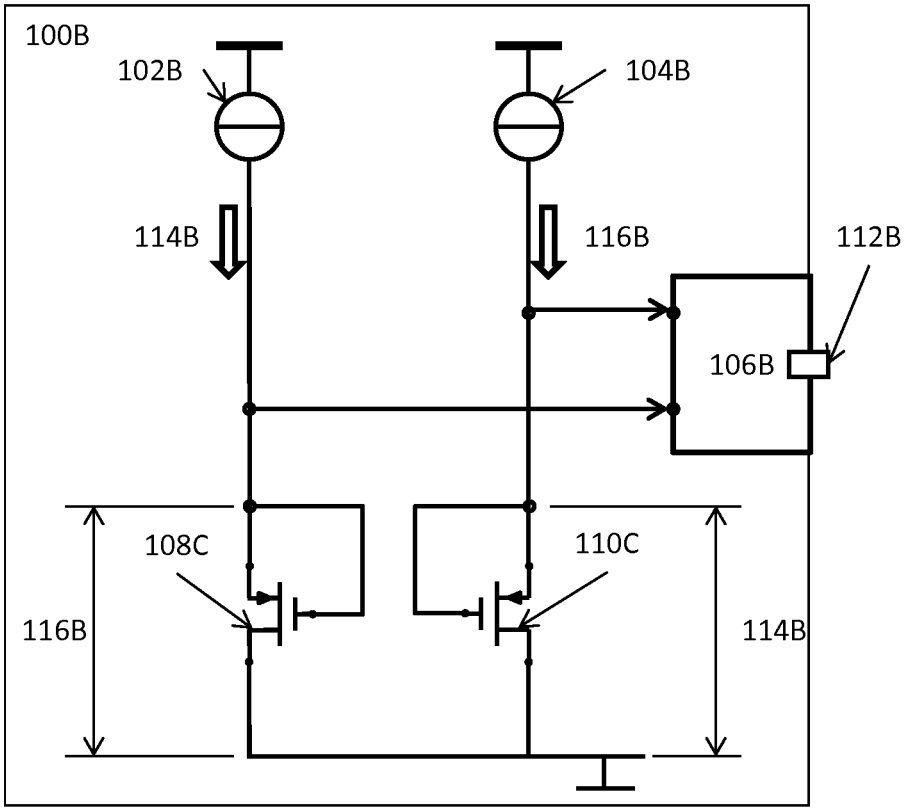
FIG. 1C illustrates another example of a temperature sensor including two CMOS-based, process insensitive current reference circuits that are identical to or substantially similar to the CMOS-based, process insensitive current reference circuit illustrated in FIG. 1A in one or more embodiments.

FIG. 1C illustrates another example of a temperature sensor including two CMOS-based, process insensitive current reference circuits that are identical to or substantially similar to the CMOS-based, process insensitive current reference circuit illustrated in FIG. 1A in one or more embodiments. More specifically, the temperature sensor illustrated in FIG. 1C differs from that illustrated in FIG. 1B in that the temperature sensor in FIG. 1C includes two FETs (field effect transistors) 108C and 110C in place of the two BJTs (bipolar junction transistors) 108B and 110B. Nonetheless, the principles and effects of the temperature sensor illustrated in FIG. 1B still apply to the temperature sensor illustrated in FIG. 1C.

Figure 2A:
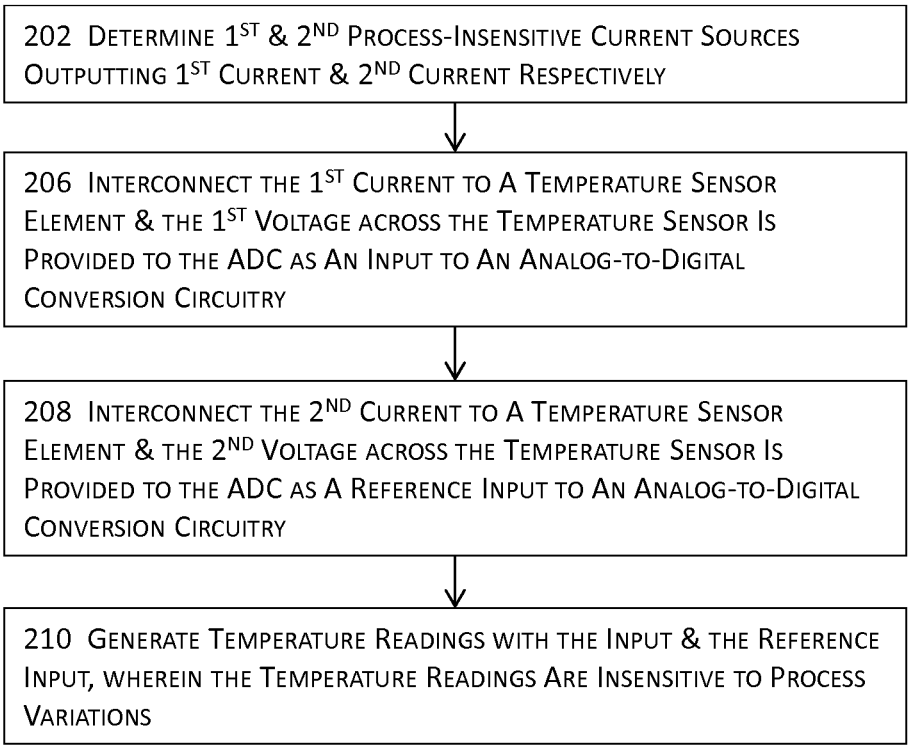
FIG. 2A illustrates a high level block diagram for implementing a CMOS-based, process insensitive current reference circuit in one or more embodiments.

FIG. 2A illustrates a high level block diagram for implementing a CMOS-based, process insensitive current reference circuit in one or more embodiments. More specifically, FIG. 2A illustrates a high level block diagram for implementing an apparatus that comprises one or more CMOS-based, process insensitive current reference circuits. In these embodiments, a first process-insensitive or independent current source that generates a first electric current is determined at 202. In some of these embodiments, the process-insensitive or independent current source includes the CMOS-based, process insensitive current reference circuit illustrated in FIG. 1A.

A second process-insensitive or independent current source generating a second electric current is also determined at 202. In some embodiments, the first and second process-insensitive or independent current sources are determined to generate the first electric current and the second electric current at a predetermined current ratio. For example, the first process-insensitive or independent current source may generate the first electric current "I", and the second process-insensitive or independent current source may generate the second electric current "N×I", where the multiplication factor N is a predetermined number greater than one ("1").

In some embodiments, a larger multiplication factor N produces the reference voltage that is more PTAT (proportional to absolute temperature) in nature but requires more area on silicon. In one embodiment, the multiplication factor N is 7. The multiplication factor N may be determined based in part or in whole upon the accuracy requirements of the apparatus implemented with the process illustrated in FIG. 2A. For example, a larger multiplication factor (e.g., N=16) may be chosen for apparatuses requiring higher accuracy because the larger multiplication factor renders the reference voltage more proportional to absolute temperature and thus reduces inaccuracies arising from the disproportionality of the reference voltage with respect to absolute temperature.

The first and second process-insensitive or independent current sources may be respectively coupled with a corresponding feedback or compensation circuitry. The feedback or compensation circuitry serves to adjust the output reference voltage ($V_{REF}$) such as the output reference voltage 108 in FIG. 1A in order to maintain the resistance of a resistive transistor in the process-insensitive or independent current source at or about a constant resistance value such that the process-insensitive or independent current source may generate a constant or substantially constant electric current, independent of process variations. More details about interconnecting the first and second process-insensitive or independent current sources to a feedback or compensation circuitry are described in the description of FIG. 1A.

At 206, the first output of the first electric current may be interconnected directly or indirectly to a first temperature dependent sensor element that is further interconnected, via zero or more other circuit components or modules, to an analog-to-digital conversion (ADC) circuitry such that the first electric current or a voltage level (e.g., a base-emitter voltage or $V_{BE}$) of the first temperature dependent sensor element may serve as an input to an analog-to-digital conversion circuitry. The second output of the first electric current may also be interconnected directly or indirectly to a second temperature dependent sensor element that is further interconnected, via the zero or more other circuit components or modules, to the analog-to-digital conversion (ADC) circuitry at 208 such that the second electric current or another voltage level (e.g., another base-emitter voltage or $V_{BE}$) of the second temperature dependent sensor element may serve as a reference input to the analog-to-digital conversion circuitry. The ADC circuitry may then process the input and the reference input to calculate the temperature readings and to generate digital output for the temperature readings. More details about interconnecting the respective outputs of the first and second process-insensitive or independent current sources to an analog-to-digital circuitry are described in the description of FIG. 1A.

Digital output readings (e.g., digital output readings for measured temperatures) may be generated at 210 with the input and the reference input by the analog-to-digital conversion circuitry; and the digital output readings are independent of or insensitive to process variations in the manufacturing processes used to fabricate various components (e.g., various transistors) in the apparatus. In some embodiments, the first and second process-insensitive or independent current sources respectively generate and maintain the first and second electric currents at respective constant or substantially constant values.

The process-insensitive or independent current sources described in these embodiments are in sharp contrast with conventional electric sources that generate constant output voltages because the process-insensitive or independent current sources described herein vary the output reference voltages (e.g., $V_{REF}$ 108 in FIG. 1A) so as to maintain the generated electric currents at their respective constant or substantially constant values.

Figure 2B:
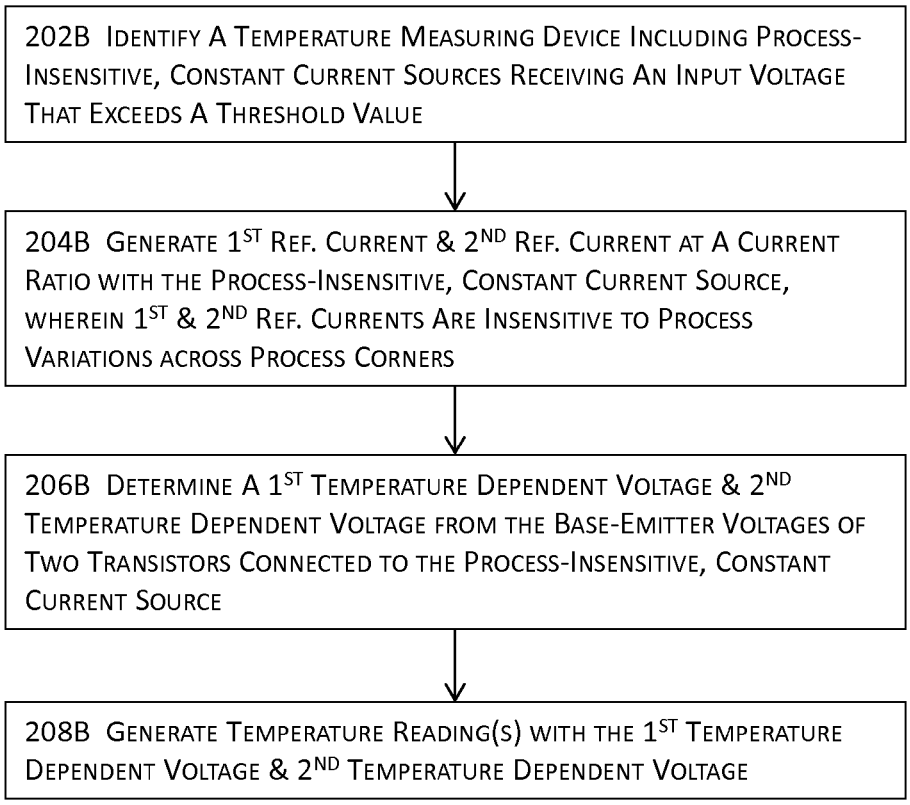
FIG. 2B illustrates another high level block diagram for implementing an apparatus with CMOS-based, process insensitive current reference circuits in one or more embodiments.

FIG. 2B illustrates another high level block diagram for implementing an apparatus with CMOS-based, process insensitive current reference circuits in one or more embodiments. More specifically, FIG. 2B illustrates a high level block diagram for implementing an apparatus that comprises one or more CMOS-based, process insensitive current reference circuits. In these one or more embodiments, a temperature measurement device (e.g., a temperature sensor) is identified at 202B. in some embodiments, the apparatus or even a portion thereof (e.g., a CMOS-based, process insensitive current reference circuit) may be embedded into a system on chip (SoC).

The temperature measurement device includes a plurality of process-independent or insensitive, constant current sources. The inputs of the plurality of process-independent or insensitive, constant current sources are interconnected in such a way to receive an input voltage ($V_{DD}$) that exceeds a threshold value. The input voltage is devised to exceed a threshold value in order to bias various transistors to operate in the saturation region. In some embodiments where the plurality of process-independent or insensitive, constant current sources include the CMOS-based, process insensitive current source or a variant thereof illustrated in FIG. 1A, the constant transconductance circuitry receives the input source voltage 122 to bias the transistors 102, 102', 104, 110, and 106 in order to operate these transistors in the saturation region where further increases in the electric current driven into the base barely increases or does not result in an increase in the available charge carriers crossing the base-collector junction.

In this example, the base-collector junctions and the base-emitter junctions of these transistors become forward biased, and further increases in the bias voltages at the gates of these transistors result in no increase or merely marginal increases in the number of charge carriers that may cross the base-collector junctions. In saturation, a transistor appears as a near short circuit between the drain and the source producing only the saturation voltage. These transistors may also be driven out of saturation by reducing the base-emitter voltage or by reducing the current driven into the gate in order to reduce the collector current that is limited by the base current.

In these embodiments, a first current source of the plurality of process-independent or insensitive, constant current sources includes the CMOS-based, process insensitive current reference circuit illustrated in FIG. 1A and generating a first current "I"; and a second current source of the plurality of process-independent or insensitive, constant current sources includes a variant of the CMOS-based, process insensitive current source illustrated in FIG. 1A and generating a second electric current "N×I", where the multiplication factor N is a predetermined number greater than one ("1"). As described above, a larger multiplication factor N produces the reference voltage that is more PTAT in nature but requires more area on silicon. The multiplication factor N may be determined based in part or in whole upon at least the accuracy requirements of the apparatus implemented with the process flow illustrated in FIG. 2B.

At 204B, a first reference current and a second reference current may be generated at a current ratio with the plurality of process-independent or insensitive, constant current sources. The first and second reference currents are independent of or at least insensitive to process variations across process corners of various manufacturing processes used to fabricate various components in the apparatus implemented with the process illustrated in FIG. 2B.

A process corner includes one or more semiconductor fabrication parameters which, when used to manufacture an electronic design to a semiconductor substrate (e.g., a silicon wafer), cause variations in one or more physical characteristics (e.g., geometric characteristics such as lengths, thicknesses, widths, thermal characteristics, etc.) and/or electrical characteristics (e.g., resistivity, sheet resistance, conductivity, lattice structure, etc.) of the electronic design in some embodiments.

In some of these embodiments, a process corner includes the one or more semiconductor fabrication parameters which, when used to manufacture an electronic design to a semiconductor substrate, cause most variations in the one or more physical characteristics and/or electrical characteristics of the electronic design. A first temperature dependent voltage and a second temperature dependent voltage may be determined at 206B from the base-emitter voltages of two transistors that are respectively coupled with the plurality of process-independent or insensitive, constant current sources.

In the example illustrated in FIG. 1C, the plurality of process-independent or insensitive, constant current sources include the first current source 104B and the second current source 102B that are coupled with and drive the first and second electric currents ($I_{REF}$/N 116B and $I_{REF}$ 114B) into transistors 110C and 108C. In this example, the first temperature dependent voltage may include the voltage that is proportion to absolute temperature (PTAT); and the second temperature dependent voltage may include the voltage obtained by adding the base-emitter voltage ($\Delta V_{BE}$) of a transistor (e.g., 110C) and an amplified difference in the base-emitter voltages ($\alpha\Delta V_{BE}$) of the two transistors (e.g., 110C and 108C).

For example, the first temperature dependent voltage may include $\alpha\times\Delta V_{BE}$, and the second temperature dependent voltage (e.g., $V_{REF}$) may be ($V_{BE}+\alpha\times\Delta V_{BE}$) that is PTAT in nature. Digital reading output (e.g., digital reading output for temperature readings) may be generated at 208B with the first and second temperature dependent voltages. In some embodiments, digital reading output may be generated at 208B by using at least an analog-to-digital conversion circuitry that may be located within or external to the apparatus implemented with the process illustrated in FIG. 2B.

In the aforementioned example in the description of 206B, the analog-to-digital conversion circuitry may convert both the $V_{REF}$ and $\alpha\times\Delta V_{BE}$ to produce the digital reading output by using the equation digital reading output=$\text{Constant}_1\times(\alpha\times\Delta V_{BE}/V_{REF})-\text{Constant}_2$. Both constants may be determined based in part or in whole upon the scale or unit of measurement for temperature (e.g., Celsius, Fahrenheit, Kelvin). In some embodiments where the temperature is reported in Celsius, A and B are 600 and 273, respectively. In some embodiments where the reference voltage ($V_{REF}$) and the input voltage ($V_{IN}$) are provided to an analog-to-digital conversion circuitry, the digital reading output may be generated by using, for example, Equation (13) above.

Figure 2C:
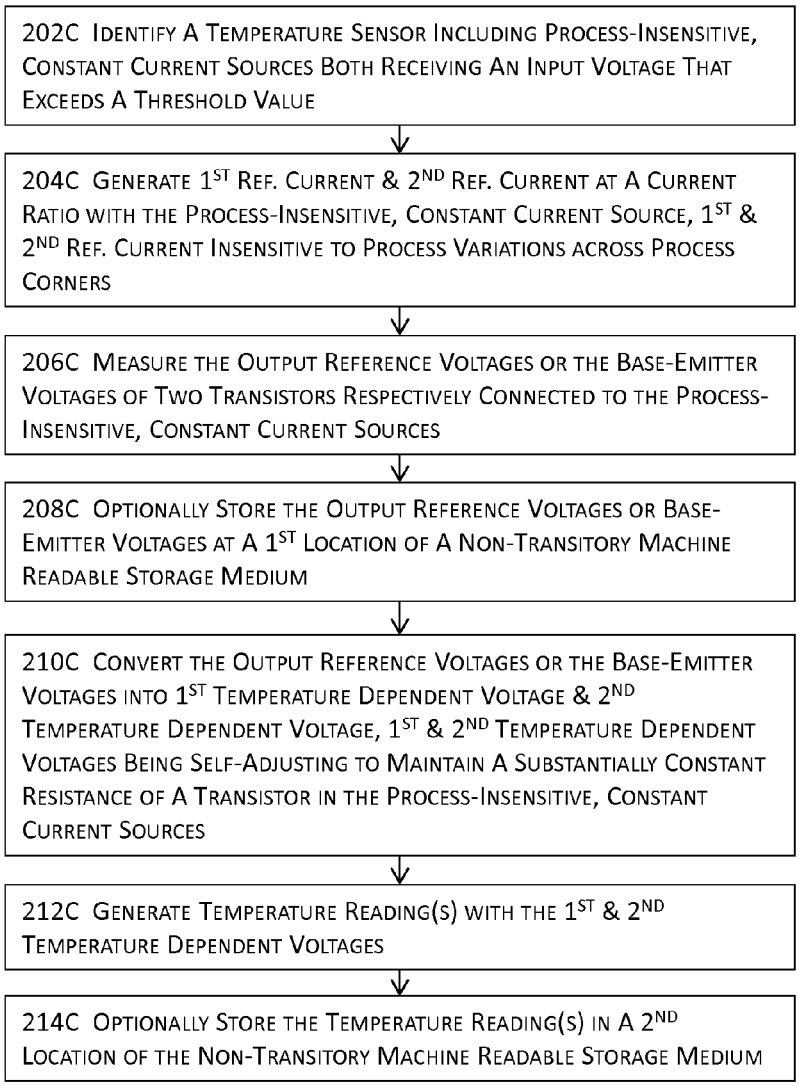
FIG. 2C illustrates another high level block diagram for implementing an apparatus with CMOS-based, process insensitive current reference circuits in one or more embodiments.

FIG. 2C illustrates another high level block diagram for implementing an apparatus with CMOS-based, process insensitive current reference circuits in one or more embodiments. In these one or more embodiments, a temperature measurement device (e.g., a temperature sensor) is identified at 202C. in some embodiments, the apparatus or even a portion thereof (e.g., a CMOS-based, process insensitive current reference circuit) may be embedded into a system on chip (SoC).

The temperature measurement device includes a plurality of process-independent or insensitive, constant current sources including, for example, a CMOS-based, process insensitive current reference circuit, a variant thereof, or any combinations thereof. The inputs of the plurality of process-independent or insensitive, constant current sources are interconnected in such a way to receive an input voltage ($V_{DD}$) that exceeds a threshold value to bias various transistors to operate in the saturation region.

The plurality of CMOS-based, process insensitive current reference circuits may include the current reference circuit illustrated in FIG. 1A and generating the first reference current. The plurality of CMOS-based, process insensitive current reference circuits may further include a variant of the current reference circuit illustrated in FIG. 1A and generating N-times of the first reference current as the second reference current, where N is a multiplication factor greater than one ("1"). The multiplication factor N may be determined based in part or in whole upon the accuracy requirements of the apparatus where a larger multiplication factor renders the temperature dependent voltage more proportional to absolute temperature.

At 204C, a first reference current and a second reference current at a current ratio may be generated with the plurality of process-independent or insensitive, constant current sources. By virtue of the process-independent or insensitive, constant current sources, the first and second reference currents are independent of or insensitive to process variations across process corners. The output reference voltages (e.g., $V_{REF}$ in FIG. 1A) produced by the plurality of process-independent or insensitive, constant current sources or the base-emitter voltages ($V_{BE}$) of two transistors that are respectively coupled with the plurality of process-independent or insensitive, constant current sources may be measured at 206C.

The output reference voltages or the base-emitter voltages may be further transmitted to a data processing module in some embodiments or an analog-to-digital conversion circuitry in some other embodiments for further processing. The output reference voltages or the base-emitter voltages may be optionally stored at 208C at a first location in a non-transitory machine accessible storage medium (e.g., a memory, a flop, a register, a buffer, etc.) in some embodiments.

The term "non-transitory computer readable storage medium", "non-transitory computer usable storage medium", "non-transitory machine accessible storage medium", or the like as used herein refers to any non-transitory storage medium that participates in providing instructions to a computer processor for execution. Such a medium may take many forms, including but not limited to, non-volatile media and volatile media. Non-volatile media includes, for example, optical or magnetic disks, such as disk drive. Volatile media includes dynamic memory, such as system memory.

Common forms of non-transitory computer or machine readable storage media includes, for example, electromechanical disk drives (such as a floppy disk, a flexible disk, or a hard disk), a flash-based, RAM-based (such as SRAM, DRAM, SDRAM, DDR, MRAM, etc.), flops, registers, buffers, or any other solid-state drives (SSD), magnetic tape, any other magnetic or magneto-optical medium, CD-ROM, any other optical medium, any other physical medium with patterns of holes, RAM, PROM, EPROM, FLASH-EPROM, any other memory chip or cartridge, or any other medium from which a computer can read.

In some embodiments where base-emitter voltages are measured at 206C, the base-emitter voltages may be converted at 210C into a first temperature dependent voltage (e.g., $V_{REF}$ in some of the embodiments illustrated in FIG. 1B) and a second temperature dependent voltage (e.g., $V_{IN}$ in some of the embodiments illustrated in FIG. 1B). Both the first and second temperature dependent voltages are self-adjusting by, for example, regulate or manipulate the multiplying factor of a current adjustment transistor (e.g., 104 in FIG. 1A) to maintain the resistance of a resistive transistor or even the current source at a constant or substantially constant value regardless of process variations such that the generated current from the current source is also maintained at a constant or substantially constant current value regardless of process variations.

Digital reading output (e.g., temperature readings) may be generated at 212C with the first and second temperature dependent voltages by an analog-to-digital conversion circuitry or by a data processing module (e.g., 106B). In some embodiments where temperature dependent $V_{REF}$ and temperature dependent $V_{in}$ are measured and processed as in some of the embodiments illustrated in FIG. 1B, the digital reading output may be generated by converting both $V_{REF}$ and $V_{in}$ using Equation (13) described above.

In some embodiments where the base-emitter voltages are measured from one of the two transistors respectively coupled with the plurality of CMOS-based, process insensitive current reference circuits, the digital reading output may be generated by converting and an amplified difference in the base-emitter voltages ($\alpha\Delta V_{BE}$) and a reference voltage ($V_{REF}$) that is the sum of a base-emitter voltage ($V_{BE}$) and the amplified difference in the base-emitter voltages ($\alpha\Delta V_{BE}$) (e.g., $V_{REF}=V_{BE}\ \alpha\Delta V_{BE}$) as described above in the description of reference numeral 208B of FIG. 2B. The digital reading output may be optionally stored at 214C at a second location of the same or a different non-transitory machine accessible storage medium.

Figure 3A:
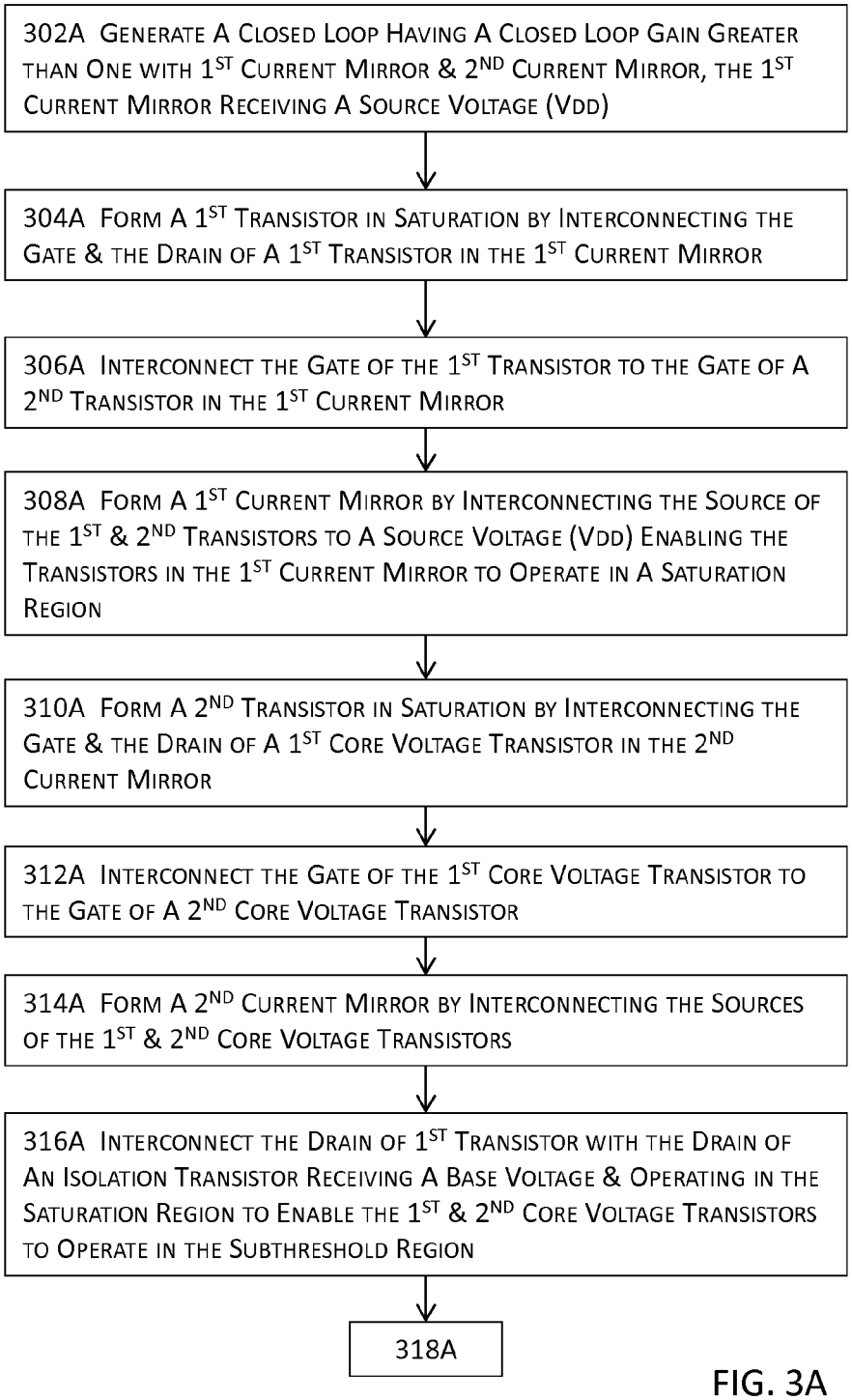
FIGS. 3A-B jointly illustrates a more detailed block diagram for implementing a CMOS-based, process insensitive current reference circuit in one or more embodiments.
Figure 3B:
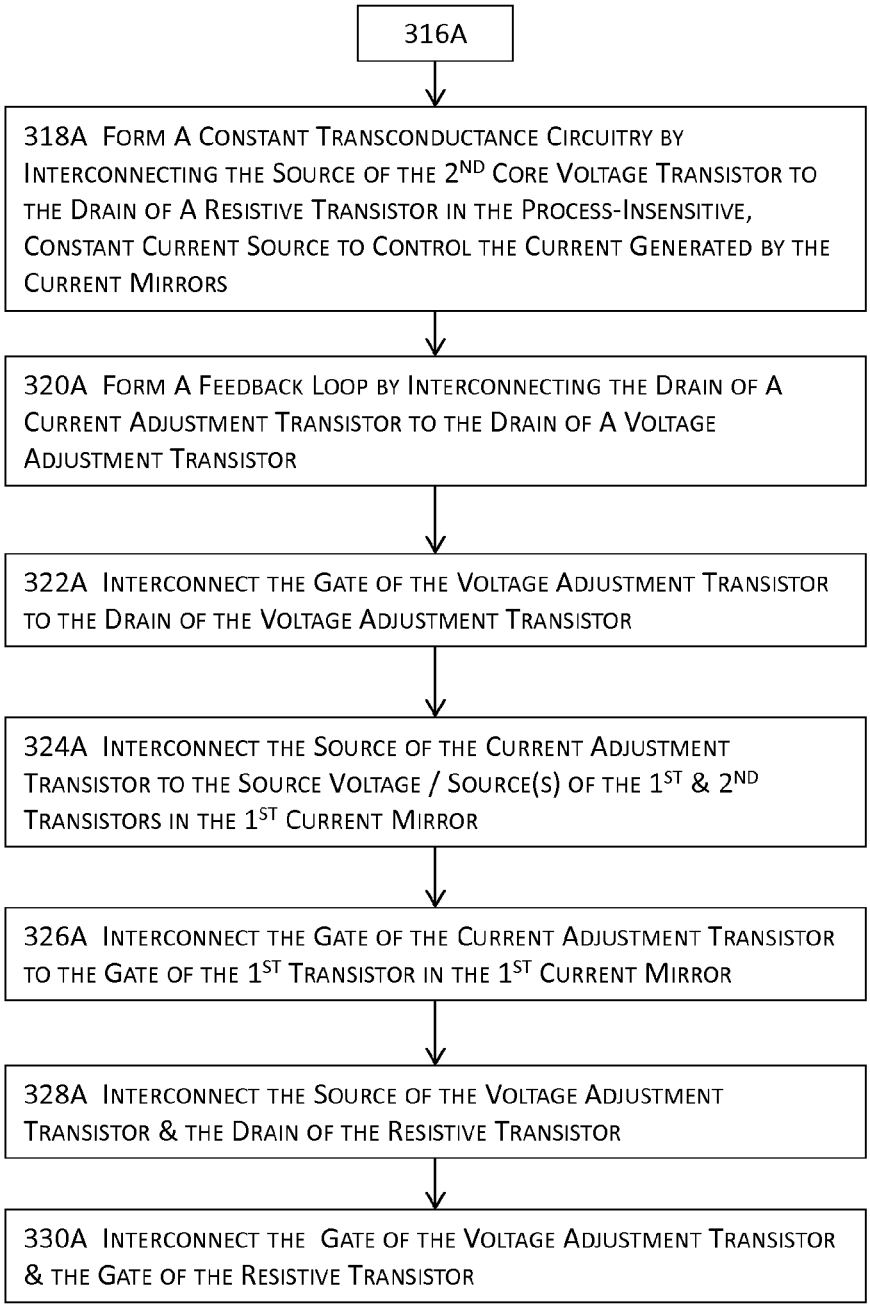

FIGS. 3A-B jointly illustrates a more detailed block diagram for implementing a CMOS-based, process insensitive current reference circuit in one or more embodiments. More specifically, FIGS. 3A-B jointly illustrate more details about the block diagram for implementing a CMOS-based, process insensitive current reference circuit illustrated in FIG. 2A. In these one or more embodiments, a closed loop having a gain greater than one ("1") in a constant transconductance circuitry may be generated at 302A with a first current mirror and a second current mirror.

The first current mirror in the constant transconductance circuitry receives an source voltage ($V_{DD}$) as an input to the constant transconductance circuitry. A first reversed transistor in saturation may be formed at 304A by interconnecting the gate and the drain of a first transistor (e.g., 102' in FIG. 1A) in the first current mirror. The gate of the first transistor may also be interconnected at 306A to the gate of a second transistor (e.g., 102 in FIG. 1A) in the first current mirror. The first current mirror may be formed at 308A by interconnecting the sources of the first and second transistors to the source voltage ($V_{DD}$) that enables the first and second transistors in the first current mirror to operate in a saturation region. For example, the gates of transistors 102 and 102' in FIG. 1A may be coupled with form the first current mirror.

A second reversed transistor in saturation may be formed at 310A by interconnecting the gate and the drain of a first core voltage transistor (e.g., 114 in FIG. 1A) in the second current mirror. The gate of the first core voltage transistor may also be interconnected at 312A to the gate of a second core voltage transistor (e.g., 116 in FIG. 1A) in the first current mirror. The second current mirror may be formed at 314A by interconnecting the sources of the first and second core voltage transistors. For example, the gates of transistors 114 and 116 in FIG. 1A may be coupled with form the second current mirror.

In some embodiments, the first and second core voltage transistors operate in the sub-threshold region where the gate voltage ($V_G$) is less than the threshold voltage ($V_{TH}$) and may be subject to a limited maximum drain-to-source voltage ($V_{DS}$) (e.g., 1.1V maximum $V_{DS}$), whereas the first and second transistors in the first current mirror may be subject to a higher maximum drain-to-source voltage (e.g., 1.98V maximum $V_{DS}$). To protect the first and second core voltage transistors in the second current mirror, an isolation transistor (e.g., 110 in FIG. 1A) receiving a base bias voltage (e.g., 112 in FIG. 1A) may be interposed between the first and second current mirrors.

This isolation transistor serves to isolate the first and second core voltage transistors in the second current mirror and may be subject to a higher bias voltage (e.g., 2.5V) at the base to operate in the saturation region. In some of these embodiments, the isolation transistor includes an NPN transistor having a drain-to-source voltage larger than or equal to an predetermined voltage value (e.g., 100 mV). In some other embodiments, the isolation transistor includes a transistor having a drain-to-source voltage ($V_{DS}$) to thermal voltage ($V_T$) ratio larger than or equal to a predetermined ratio (e.g., 4) to isolate the lower voltage first and second core voltage transistors in the second current mirror from a higher voltage value (e.g., a voltage higher than 1.1V) to protect the first and second core voltage transistors from exhibit or resulting in reliability or functional issues due to exposure to excessive voltages.

At 316A, the drain of the first transistor in the first current mirror may be coupled with the drain of the isolation transistor that receives a base voltage ($V_B$) to enable the first and second core voltage transistors to operate in the sub-threshold region. In some embodiments, the isolation transistor is devised to operate in the saturation region so that the relation between the current generated by a current source, the threshold voltage, the drain-to-source voltage, and the reference voltage may be established as shown in Equation (7) described above.

A constant transconductance circuitry (constant $g_m$ circuitry) may be formed at 318A by interconnecting the source of the second core voltage transistor to the drain of a resistive transistor (e.g., 120 in FIG. 1A). The resistive transistor is biased to operate in the linear region. In some embodiments, the resistive transistor is biased to operate in the linear region to simplify the voltage-current-resistance relationship. Unlike conventional constant $g_m$ circuits including a conventional resistor, the constant transconductance circuitry described herein includes a resistive transistor (e.g., a MOSFET) instead of a conventional resistor (e.g., a poly-resistor, a metal resistor, a MOSFET in linear region, etc.)

The resistive transistor controls the amount of current generated by the process-insensitive, constant current source, and its resistance value is maintained at a constant or substantially constant value regardless of process variations by the feedback or compensation loop. At 320A, a feedback loop may be formed by interconnecting the drain of a current adjustment transistor (e.g. 104 in FIG. 1A) to the drain of a voltage adjustment transistor (e.g., 106 in FIG. 1A). The gate of the voltage adjustment transistor may be interconnected at 322A to the drain of the voltage adjustment transistor to effectively turn the voltage adjustment transistor into a reversed transistor.

The source of the current adjustment transistor may also be interconnected the source voltage ($V_{DD}$) and hence the sources of the first and second transistors in the first current mirror at 324A. The gate of the current adjustment transistor may further be coupled with the gate of the first transistor in the first current mirror at 326A. The source of the voltage adjustment transistor may also be coupled with the drain of the resistive transistor at 328A; and the gate of the voltage adjustment transistor may be coupled with the gate of the resistive transistor at 330A to complete the interconnection of the feedback loop to the constant transconductance circuitry for a CMOS-based process insensitive current reference circuit.

Figure 3C:
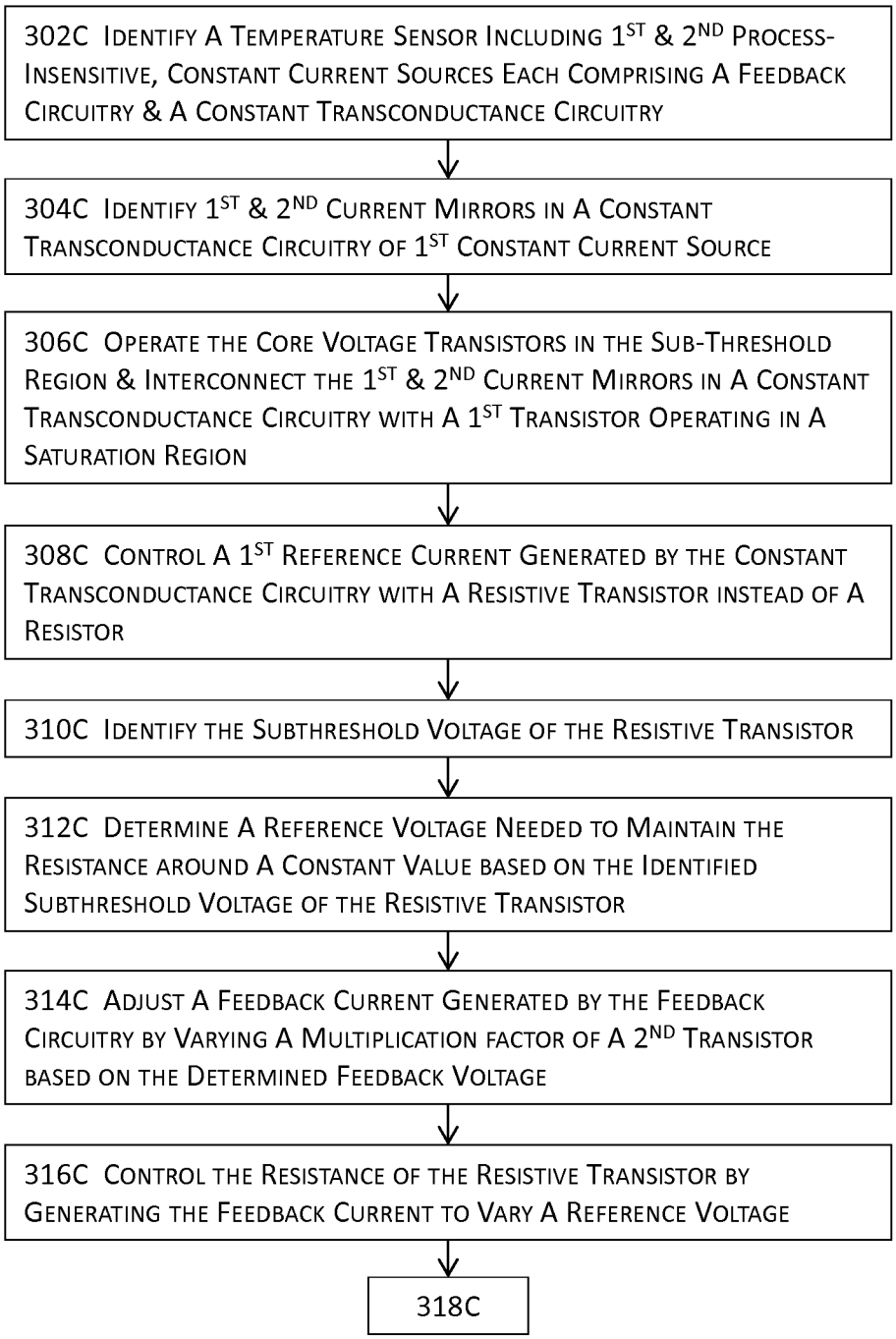
FIGS. 3C-D jointly illustrates a more detailed block diagram for implementing an apparatus with CMOS-based, process insensitive current reference circuits in one or more embodiments.
Figure 3D:
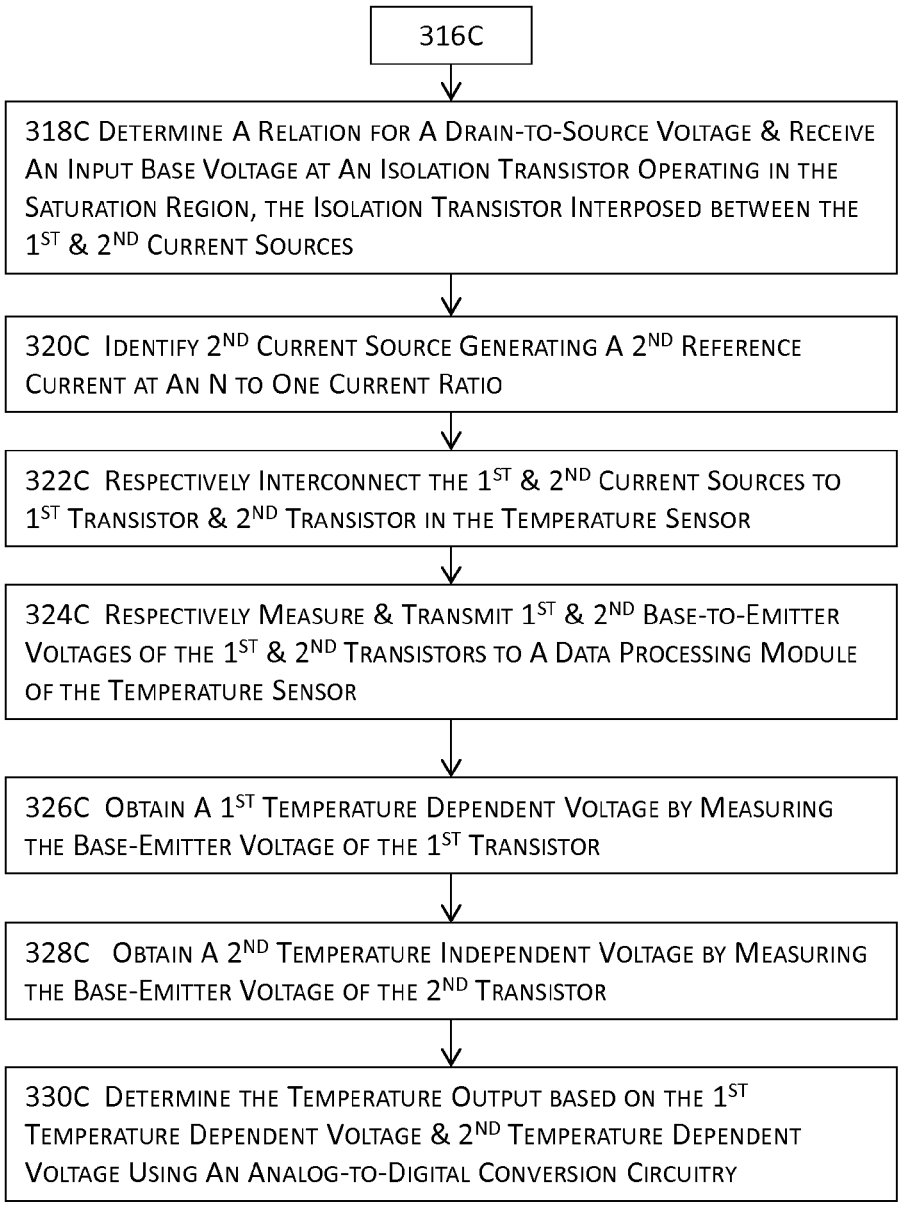

FIGS. 3C-D jointly illustrates a more detailed block diagram for implementing an apparatus with CMOS-based, process insensitive current reference circuits in one or more embodiments. More specifically, FIGS. 3C-D jointly illustrate more details about the block diagram for implementing an apparatus with CMOS-based, process insensitive current reference circuits illustrated in FIG. 2A. In these one or more embodiments, a temperature measurement device (e.g., a temperature sensor) including a first and second process-insensitive, constant current sources may be identified at 302C.

Each of the first and second process-insensitive, constant current sources includes a feedback circuitry and a constant transconductance circuitry. A first and second current mirrors in a constant transconductance circuitry of the first process-insensitive, constant current source may be identified at 304C. The core voltage transistors in the second current mirror may be biased at 306C to operate in the sub-threshold region, and the transistors in the first current mirror may be biased to operate in the saturation region.

In addition, an isolation transistor receiving a base bias voltage ($V_B$) may be coupled with both the first and second current mirrors to protect the core voltage transistors in the second current mirror at 306C. The first reference current generated by the constant transconductance circuitry may be controlled at 308C by adding a resistive transistor to the constant transconductance circuitry. In these embodiments, the constant transconductance circuit includes the resistive transistor (e.g., a FET or MOSFET) instead of a conventional resistor as in conventional constant $g_m$ circuits.

The resistance of the resistive transistor may be maintained at a constant or substantially constant resistance value by varying the current flowing in the feedback circuitry to adjust the reference voltage at the gate of the resistive transistor in an identical or substantial similar manner in which the threshold voltage of the resistive transistor or the constant transconductance circuitry varies across manufacturing process variations in some embodiments. In these embodiments, the resistance value of the resistive transistor varies in an identical or substantially similar manner as the variation of the threshold voltage in the constant or substantially constant transconductance circuitry, and the CMOS-based, process insensitive current reference circuit generates a constant or substantially constant electric current independent of or insensitive to the variations of the threshold voltage due to variations of the manufacturing processes.

The threshold voltage of the resistive transistor may be identified at 310C, and a reference voltage needed to maintain the resistance value of the resistive transistor at a constant or substantially constant value may be determined at 312C based in part or in whole upon the threshold voltage of the resistive transistor identified at 310C. A feedback current generated by the feedback circuitry may be adjusted at 314C by varying a multiplication factor of a second transistor (e.g., 104 in FIG. 1A) based in part or in whole upon the reference voltage determined at 312C. The resistance of the resistive transistor may be controlled or maintained at a constant or substantially constant resistance value at 316C by generating the feedback current to vary a reference voltage (e.g., 108 in FIG. 1A).

A relation for a drain-to-source voltage ($V_{DS}$) may be determined, and an input base voltage ($V_B$) may be received at an isolation transistor to bias the isolation transistor to operate in the saturation region at 318C. In some embodiments, the isolation transistor interconnects both the first and second CMOS-based, process insensitive current reference circuits. A second process-insensitive, constant current source generating a second reference current at a current ratio ("N") with respect to the first reference current generated by the first process-insensitive, constant current source may be identified at 320C.

The current ratio includes a number that is greater than one ("1"). In some embodiments, the current ratio is 7. The first and second process-insensitive, constant current sources may be respectively interconnected at 322C to a first transistor and a second transistor in the temperature measurement device. The base-to-emitter voltages of the first and second transistors may be respectively measured and transmitted at 324C to an data processing module of the temperature measurement device in some embodiments.

A first temperature dependent voltage may be obtained at 326C by measuring the base-emitter (or gate-source) voltage of the first transistor. In some embodiments, the first temperature dependent voltage may be obtained by reading an amplified difference (e.g., $\alpha \times \Delta V_{BE}$) between the first and the second base-emitter (or gate-source) voltages of the first and second transistors in the temperature measurement device. A second temperature dependent voltage may also be obtained at 328C by measuring the base-emitter voltage of the second transistor. In some embodiments, the second temperature dependent voltage may be obtained by adding the base-emitter voltage ($V_{BE}$) of the first transistor and the temperature dependent voltage (e.g., $\alpha \times \Delta V_{BE}$). The digital reading output may then be determined at 330C by forwarding both the first and second temperature dependent voltages to an analog-to-digital conversion module by using Equation (13) described above.

In some other embodiments including a first process-insensitive, constant current source generating a first electric current (e.g., $I_{REF}/N$) and a second process-insensitive, constant current source generating a second electric current (e.g., $I_{REF}$), the first output reference voltage output by the first process-insensitive, constant current source and the second output reference voltage output by the first process-insensitive, constant current source may be measured and transmitted respectively as $V_{IN}$ and $V_{REF}$ into an analog-to-digital conversion module at 324C. In these embodiments, the digital reading output may be determined at 330C by forwarding both $V_{IN}$ and $V_{REF}$ into the analog-to-digital conversion module according to the equation digital reading output=$\text{Constant}_1 \times (\alpha \times \Delta V_{BE} N_{REF}) - \text{Constant}_2$ as described above in the description of FIG. 2B.

In the foregoing specification, the invention has been described with reference to specific embodiments thereof. It will, however, be evident that various modifications and changes may be made thereto without departing from the broader spirit and scope of the invention. For example, the above-described process flows are described with reference to a particular ordering of process actions. However, the ordering of many of the described process actions may be changed without affecting the scope or operation of the invention. The specification and drawings are, accordingly, to be regarded in an illustrative rather than restrictive sense.

I claim:

1. An apparatus, comprising:

a first CMOS-based, process insensitive current reference circuit generating a first electric current;

a first transistor coupled with the first CMOS-based, process insensitive current reference circuit comprising a first current mirror, a second current mirror, and an isolation transistor that is connected to both the first current mirror and the second current mirror;

a second CMOS-based, process insensitive current reference circuit generating a second electric current;

a second transistor coupled with at least the first CMOS-based, process insensitive current reference circuit; and a data processing module coupled with the first a first CMOS-based, process insensitive current reference circuit and the second CMOS-based, process insensitive current reference circuit.

2. The apparatus of claim 1, wherein the first CMOS-based, process insensitive current reference circuit further comprises a first voltage adjustment transistor comprising a first drain and a first gate that is connected to the first drain, and the first transistor is coupled with the first CMOS-based, process insensitive current reference circuit and generates a first voltage in response to the first electric current generated by the first CMOS-based, process insensitive current reference circuit.

3. The apparatus of claim 2, the second transistor coupled with the second CMOS-based, process insensitive current reference circuit and generating a second voltage in response to the second electric current generated by the first CMOS-based, process insensitive current reference circuit.

4. The apparatus of claim 3, the first and second CMOS-based, process insensitive current reference circuit being devised to respectively generate the first electric current and the second electric current at a current ratio that is greater than one.

5. The apparatus of claim 3, wherein the second CMOS-based, process insensitive current reference circuit further comprises a second voltage adjustment transistor that comprises a second drain and a second gate that is connected to the second drain, and the data processing module comprises an analog-to-digital conversion module that converts the first voltage and the second voltage into a digital reading output.

6. The apparatus of claim 3, the first electric current being maintained at a first value, and the second electric current being maintained at a second value across one or more process corners.

7. A method for implementing a system on chip comprising one or more CMOS-based, process insensitive current reference circuits, comprising:

identifying a first reference electric current generated by a first CMOS-based, process insensitive current reference circuit and a second reference electric current generated by a second CMOS-based, process insensitive current reference circuit;

identifying, in the first CMOS-based, process insensitive current reference circuit, a first current mirror, a second current mirror, and an isolation transistor that is interposed between the first current mirror and the second current mirror;

determining a first temperature dependent voltage and a second temperature dependent voltage produced by the first and second CMOS-based, process insensitive current reference circuits at least by operating the second current mirror of the first CMOS-based, process insensitive current reference circuit in a sub-threshold region using at least the isolation transistor;

storing the first temperature dependent voltage and the second temperature dependent voltage respectively at a first location and a second location of a non-transitory machine readable storage medium; and generating a digital reading output by transforming the first dependent voltage and the second temperature dependent voltage that are respectively stored at the first location and the second location of the non-transitory machine readable storage medium.

8. The method of claim 7, further comprising:

identifying a temperature measurement device comprising the first and second CMOS-based, process insensitive current reference circuits.

9. The method of claim 8, further comprising:

identifying a first transistor that is coupled with and receives the first reference electric current generated by the first CMOS-based, process insensitive current reference circuit; and determining a first base-to-emitter voltage produced by the first transistor in response to the first reference electric current.

10. The method of claim 9, further comprising:

identifying a second transistor that is coupled with and receives the second reference electric current generated by the second CMOS-based, process insensitive current reference circuit; and determining a second base-to-emitter voltage produced by the second transistor in response to the second reference electric current.

11. The method of claim 10, further comprising:

storing the first base-to-emitter voltage as an input voltage in the non-transitory machine readable storage medium;

storing the second base-to-emitter voltage as an input voltage in the non-transitory machine readable storage medium;

determining the first temperature dependent voltage by multiplying an amplification factor with a difference between the first base-to-emitter voltage and the second base-to-emitter voltage; and determining the second temperature dependent voltage by adding the temperature dependent voltage to either the first base-to-emitter voltage or the second base-to-emitter voltage.

12. The computer implemented method of claim 7, further comprising:

controlling the first reference electric current at a first constant value at least by maintaining a first resistance value of a first resistive transistor in the first CMOS-based, process insensitive current reference circuit; and controlling the second reference electric current at a second constant value at least by maintaining a second resistance value of a second resistive transistor in the second CMOS-based, process insensitive current reference circuit.

13. The computer implemented method of claim 12, controlling the first reference electric current further comprising:

adjusting a first adjustment electric current with a first adjustment in a first feedback circuitry in the first CMOS-based, process insensitive current reference circuit according to first variations of a first threshold voltage of a first transistor in the first CMOS-based, process insensitive current reference circuit with respect to process variations in manufacturing of the system on chip or a part thereof;

adjusting a first reference voltage produced by the first CMOS-based, process insensitive current reference circuit based in part upon the first adjustment to the first adjustment electric current; and maintaining the first resistance value of the first resistive transistor in the first CMOS-based, process insensitive current reference circuit at or around a first constant.

14. The computer implemented method of claim 12, controlling the second reference electric current further comprising:

adjusting a second adjustment electric current with a second adjustment in a second feedback circuitry in the second CMOS-based, process insensitive current reference circuit according to second variations of a second threshold voltage of a second transistor in the second CMOS-based, process insensitive current reference circuit with respect to the process variations in manufacturing of the system on chip or the part thereof;

adjusting a second reference voltage produced by the second CMOS-based, process insensitive current reference circuit based in part upon the second adjustment to the second adjustment electric current; and maintaining the second resistance value of the second resistive transistor in the second CMOS-based, process insensitive current reference circuit at or around a second constant.

15. The computer implemented method of claim 7, further comprising:

identifying a plurality of first transistors in a first current mirror of the first CMOS-based, process insensitive current reference circuit and biasing the plurality of first transistors to operate the plurality of first transistors in a saturation region;

identifying a plurality of second transistors in a second current mirror of the first CMOS-based, process insensitive current reference circuit and biasing the plurality of second transistors to operate the plurality of second transistors in a sub-threshold region;

identifying a plurality of first feedback transistors in the first CMOS-based, process insensitive current reference circuit and biasing the plurality of first feedback transistors to operate the plurality of first transistors in the saturation region; and identifying a first isolation transistor in the first CMOS-based, process insensitive current reference circuit and biasing the first isolation transistor to operate the first isolation transistor in a linear region.

16. The computer implemented method of claim 7, further comprising:

identifying a plurality of first transistors in a first current mirror of the second CMOS-based, process insensitive current reference circuit and biasing the plurality of first transistors to operate the plurality of first transistors in a saturation region;

identifying a plurality of second transistors in a second current mirror of the second CMOS-based, process insensitive current reference circuit and biasing the plurality of second transistors to operate the plurality of second transistors in a sub-threshold region;

identifying a plurality of second feedback transistors in the second CMOS-based, process insensitive current reference circuit and biasing the plurality of second feedback transistors to operate the plurality of first transistors in the saturation region; and identifying a second isolation transistor in the second CMOS-based, process insensitive current reference circuit and biasing the second isolation transistor to operate the first isolation transistor in a linear region.

* * * * *